US011920351B2

(12) United States Patent
Manasterski et al.

(10) Patent No.: US 11,920,351 B2
(45) Date of Patent: Mar. 5, 2024

(54) HIP VENT

(71) Applicant: BMIC LLC, Dallas, TX (US)

(72) Inventors: Tim Manasterski, Cumming, GA (US); Walter R. Zarate, Prospect Park, NJ (US); Sudhir S. Railkar, Wayne, NJ (US); Jeffrey Avitabile, Lodi, NJ (US); Peter Campbell, Wanaque, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/896,807

(22) Filed: Aug. 26, 2022

(65) Prior Publication Data

US 2023/0066983 A1 Mar. 2, 2023

Related U.S. Application Data

(63) Continuation of application No. 16/943,192, filed on Jul. 30, 2020, now Pat. No. 11,428,010, which is a continuation of application No. 14/561,432, filed on Dec. 5, 2014, now Pat. No. 10,731,351.

(60) Provisional application No. 61/912,823, filed on Dec. 6, 2013.

(51) Int. Cl.
*E04D 13/17* (2006.01)
*F24F 13/08* (2006.01)

(52) U.S. Cl.
CPC ..... *E04D 13/174* (2013.01); *E04D 13/176* (2013.01); *E04D 13/17* (2013.01); *F24F 13/08* (2013.01)

(58) Field of Classification Search
CPC ..... E04D 13/174; E04D 13/176; E04D 13/17; F24F 13/08
See application file for complete search history.

(56) References Cited

U.S. PATENT DOCUMENTS

| | | | | |
|---|---|---|---|---|
| 3,660,955 | A | 5/1972 | Simon | |
| 4,024,685 | A | 5/1977 | Aarons | |
| 4,754,589 | A | 7/1988 | Leth | |
| 4,907,499 | A | 3/1990 | James | |
| 4,924,761 | A * | 5/1990 | Macleod | E04D 13/174 454/366 |
| 5,009,149 | A | 4/1991 | MacLeod et al. | |

(Continued)

*Primary Examiner* — Brian D Mattei
*Assistant Examiner* — Omar F Hijaz
(74) *Attorney, Agent, or Firm* — Womble Bond Dickinson (US) LLP

(57) ABSTRACT

A vent is disclosed that is particularly suited to use in ventilating attic spaces beneath a hip roof. The vent is configured to be installed along a hip of the roof overlying and covering a ventilation slot formed through the roof deck along the hip. The vent includes an elongated laterally flexible top panel from which baffle arrays depend. The baffle arrays are formed of a plurality of depending arcuately curved vanes that arc away from the vent. The vanes are aerodynamically shaped to redirect wind-blown rain and snow away from the vent and are configured to block the migration of rain and snow through the vent. A pair of spongy conformable filler strips is attached beneath the edge portions of the vent. The filler strips conform to the shapes of underlying shingles when the vent is installed to fill any gaps that otherwise might be formed between the vent and the shingles. A weather filter drapes over some of the baffle arrays to allow attic air to pass but prevent ingress of blown snowflakes and raindrops.

24 Claims, 7 Drawing Sheets

(56) References Cited

U.S. PATENT DOCUMENTS

| | | | | |
|---|---|---|---|---|
| 5,052,286 | A * | 10/1991 | Tubbesing | F24F 7/02 454/365 |
| 5,095,810 | A | 3/1992 | Robinson | |
| 5,174,076 | A | 12/1992 | Schiedegger | |
| 5,458,538 | A | 10/1995 | MacLeod et al. | |
| 5,535,558 | A | 7/1996 | Rieke | |
| 5,561,953 | A * | 10/1996 | Rotter | E04D 3/30 52/302.1 |
| 6,233,887 | B1 | 5/2001 | Smith | |
| 6,308,472 | B1 | 10/2001 | Coulton et al. | |
| 6,491,581 | B1 | 12/2002 | Mankowski | |
| 6,684,581 | B2 | 2/2004 | Robinson | |
| 6,793,574 | B1 | 9/2004 | Robinson | |
| 6,881,144 | B2 | 4/2005 | Hansen | |
| 6,966,156 | B2 | 11/2005 | Dixon | |
| 7,485,034 | B2 | 2/2009 | Sells | |
| D602,579 | S | 10/2009 | Stone | |
| 7,814,715 | B2 | 10/2010 | Coulton | |
| D628,718 | S * | 12/2010 | Grubka | D25/141 |
| 8,151,524 | B2 | 4/2012 | Daddio | |
| 8,322,089 | B2 | 12/2012 | Railkar et al. | |
| 8,935,895 | B2 | 1/2015 | Mankowski | |
| 10,731,351 | B2 | 8/2020 | Manasterski et al. | |
| 11,428,010 | B2 | 8/2022 | Manasterski et al. | |
| 2004/0128920 | A1 | 7/2004 | Sharp et al. | |
| 2006/0079173 | A1 | 4/2006 | Coulton et al. | |
| 2006/0096189 | A1 | 5/2006 | Pavlansky | |
| 2008/0287053 | A1 | 11/2008 | Carlson | |
| 2008/0287054 | A1 | 11/2008 | Carlson | |
| 2009/0025316 | A1 * | 1/2009 | Coulton | F24F 7/02 454/365 |
| 2009/0130969 | A1 | 5/2009 | Grisham et al. | |
| 2010/0144266 | A1 * | 6/2010 | Lowe | F24F 7/02 454/365 |
| 2012/0096782 | A1 * | 4/2012 | Railkar | E04D 13/174 52/302.1 |
| 2013/0023197 | A1 | 1/2013 | Grisham | |
| 2014/0308891 | A1 | 10/2014 | Holland et al. | |
| 2015/0275522 | A1 | 10/2015 | King | |
| 2016/0201332 | A1 | 7/2016 | Fiser | |
| 2017/0248334 | A1 * | 8/2017 | Reisinger | F24F 6/14 |

* cited by examiner

45°

WDR-@45°

| W + R Velocity | Infiltration |
|---|---|
| 35 MPH | 0 ml |
| 70 MPH | 0 ml |
| 90 MPH | 0 ml |
| 110 MPH | 0 ml |

90°

WDR-@90°

| W + R Velocity | Infiltration |
|---|---|
| 35 MPH | 0 ml |
| 70 MPH | 0 ml |
| 90 MPH | 0 ml |
| 110 MPH | -20 ml |

0°

WDR-@0°

| W + R Velocity | Infiltration |
|---|---|
| 35 MPH | 0 ml |
| 70 MPH | 0 ml |
| 90 MPH | 0 ml |
| 110 MPH | -25 ml |

HIP VENT

CROSS REFERENCE TO RELATED APPLICATIONS

The present patent application is a continuation of previously filed, co-pending U.S. patent application Ser. No. 16/943,192, filed Jul. 30, 2020, which is a continuation of U.S. patent application Ser. No. 14/561,432, filed Dec. 5, 2014, now U.S. Pat. No. 10,731,351, issued on Aug. 4, 2020, which priority is hereby claimed to the filing date of U.S. Provisional Patent Application No. 61/912,823 entitled Hip Vent, which was filed on Dec. 6, 2013.

INCORPORATION BY REFERENCE

U.S. patent application Ser. No. 16/943,192, filed Jul. 30, 2020, U.S. patent application Ser. No. 14/561,432, filed Dec. 5, 2014, now U.S. Pat. No. 10,731,351, issued on Aug. 4, 2020, and U.S. Provisional Patent Application No. 61/912,823, filed Dec. 6, 2013, are specifically incorporated by reference herein as if set forth in their entireties.

TECHNICAL FIELD

This disclosure relates generally to attic ventilation and more specifically to shingle-over vents for installation along a hip and/or along a ridge of a shingled roof.

BACKGROUND

Ridge vents and hip vents for ventilating a shingled roof have been known and used for many years. Such vents generally are installed along a ridge or along a hip of a roof covering a pre-cut ventilation slot to the attic below. It is inherently more difficult to seal a hip slot against ingress of blowing rain and snow because, among other reasons, of the angled nature of the hip and the angled down-slope directions away from the hip. Hip vents available in the past have had various inherent problems in this regard, particularly when it comes to their ability to prevent water infiltration beneath the vent and into a ventilation slot below.

One prior art hip vent for instance features an intricate baffle and foam insert design to block weather from entering the hip slot. Due to its intricate design and water protection features, it provides for low ventilation of the attic space below. Also, during installation of the vent, large gaps can result between the vent and the varying profile of hip cap and adjacent shingles. This is particularly true for roofs covered with architectural shingles, which are highly textured and exhibit large variations in thickness. According to the prior art, these gaps must be filled with caulking to provide a sufficient seal between the plastic base of the hip vent and the shingles in order to prevent water infiltration. For hip roofs shingled with high profile thick shingles, the amount of caulking required to seal the system can be very large and can actually promote leakage over time or if not carefully applied and maintained. Also, the high profile (i.e. the thickness) of this prior art vent does not provide for an aesthetically pleasant hip roof.

Another prior art hip vent features a blade or fin arrangement intended to provide seal between the vent and the underlying shingles along the hip of a roof. However, the fins alone do not completely seal between the hip vent and the shingles below and extensive amounts of caulking can still be required to obtain a good seal. A third prior art hip vent features a design that allows for little ventilation of attic space below due to its having very limited NFA (Net Free Area). This design also requires large amounts of caulking to prevent water infiltration into a hip slot beneath the hip vent.

A need exists for an attic vent usable along the hip of a hip roof that is easily installable without the need for caulking, even for roofs with thick profiled architectural shingles; that provides for a low profile (i.e. a thinner) aesthetically pleasing vent when installed; and that effectively redirects wind-blown water and snow thereby preventing water and snow penetration beneath the vent, even during blowing rain or blowing snow. It is to the provision of such a hip vent, which also may be used as a ridge vent if desired, that the present invention is primarily directed.

SUMMARY

A low-profile shingle-over hip vent is disclosed for installation along the hips of a hip roof covering a ventilation slot cut along the hip to the attic space below. The hip vent and ventilation slot below provide attic ventilation on hip roofs where there are no or inadequate horizontal ridges along the top of the roof to provide the desired ventilation. The hip vent includes baffle arrays, filler strips, and a weather filter that provide maximum resistance to infiltration of rain and snow while the hip vent itself remains thin and aesthetically pleasing on the finished roof. The need for extensive caulking is eliminated, which reduces further the chances of leakage if the calking is not applied correctly or deteriorates over time. These and other features, aspects, and advantages will become more apparent upon review of the detailed description set forth below taken in conjunction with the accompanying drawing figures, which are briefly described as follows.

DETAILED DESCRIPTION

Reference will be made throughout the following detailed description to the annexed drawing figures that are briefly described above.

Figure 1:
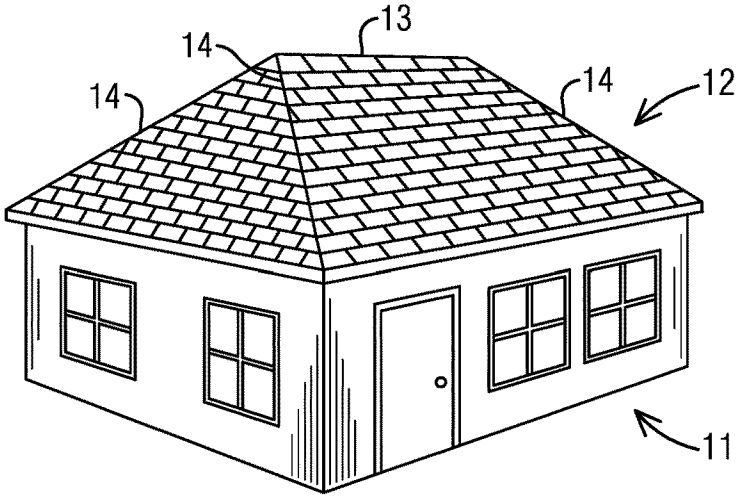
FIG. 1 is a perspective illustration of a home with a hip roof showing the hip areas extending downwardly from the ridge of the roof to the bottom corners of the roof.

FIG. 1 shows a building 11, a residential home in this case, having a hip style roof 12. The hip roof in this embodiment has a horizontally extending ridge 13 and four hips 14 that extend downwardly from the ends of the ridge to the lower corners of the roof. In such a roof, the extent of the ridge 13 is insufficient to provide the required amount of ventilation for the attic space below or to match the ventilation area of corresponding eave vents. Accordingly, additional ventilation can be provided by cutting vent slots along the hips 14 and applying hip vents over the vent slots.

Figure 2:
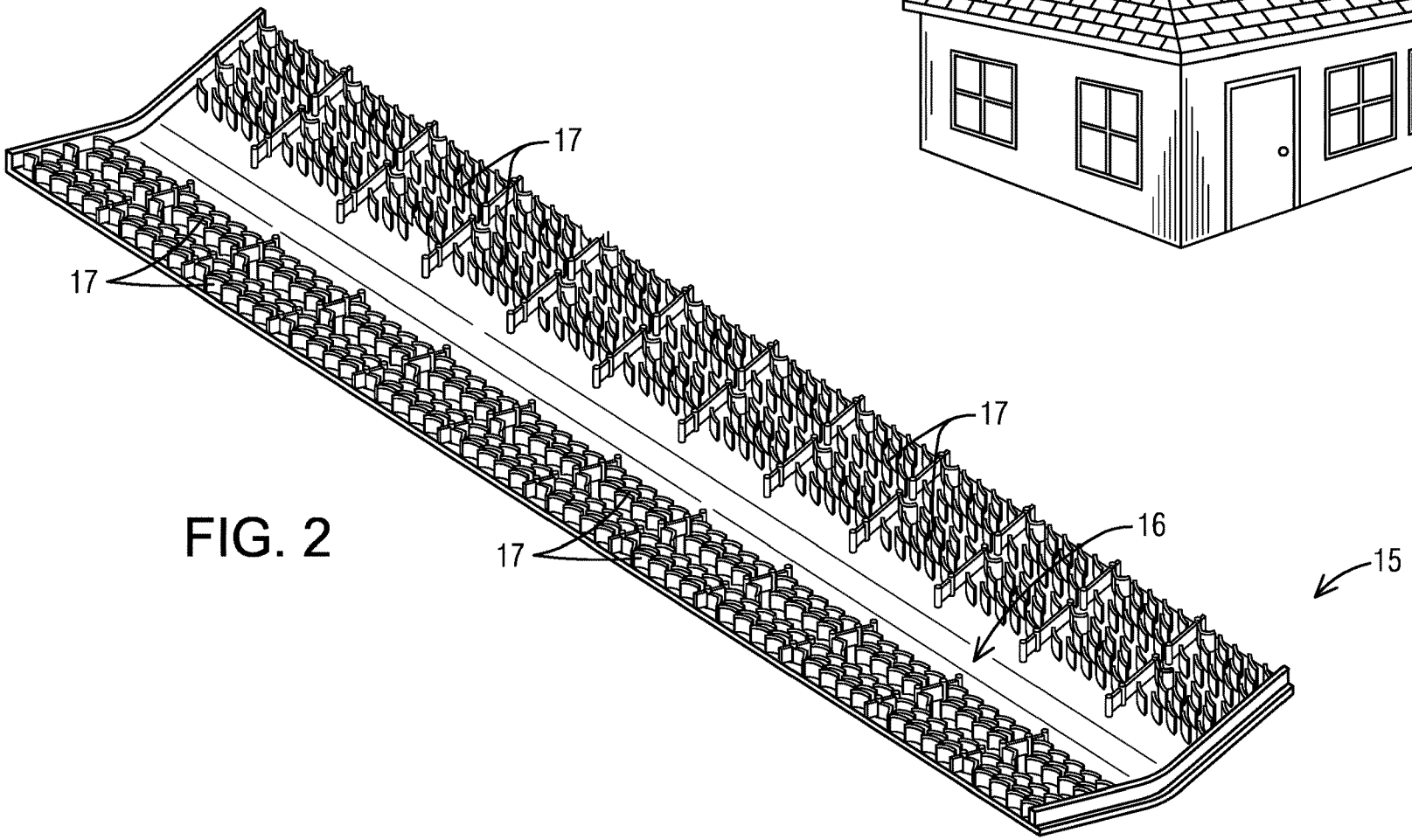
FIG. 2 is a perspective bottom view of a hip vent section that embodies principles of the invention in one preferred form.

The hip vent of the present invention is configured to be installed along the hips 14 covering a hip slot formed therealong to provide ventilation of an attic space below the roof. FIG. 2 shows the hip vent of this invention from the bottom side thereof. The hip vent 15 preferably is made of injection molded plastic and generally comprises a laterally flexible top panel 16 with baffle arrays 17 projecting from the underside of the panel along its edge portions. The baffle arrays are comprised of arcuate vanes and walls, which will be described in more detail below. Generally, the vanes are configured to allow attic air to pass out while redirecting windblown rainwater and snow away from the vent and thus to preventing rainwater and snow from entering the attic through the hip slot below the hip vent 15. As detailed below, provisions also are made according to the invention for preventing insects and debris from entering the attach beneath the installed hip vent. The hip vent 15 preferably is provided in standard lengths such as four feet and includes features at its ends for attaching the vents together end-to-end to form longer runs of hip vent.

Figure 3A:
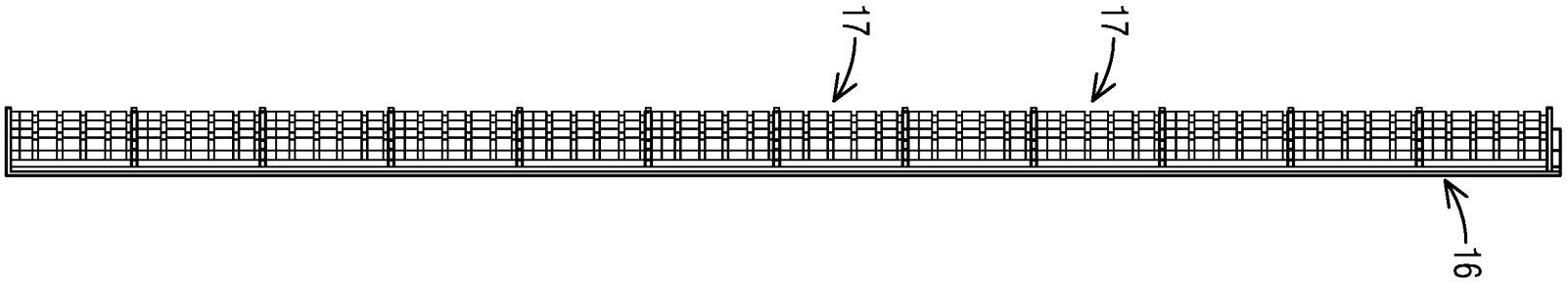
FIGS. 3*a*-3*c* show a side, top, and bottom view respectively of the hip vent shown in FIG. 2.
Figure 3B:
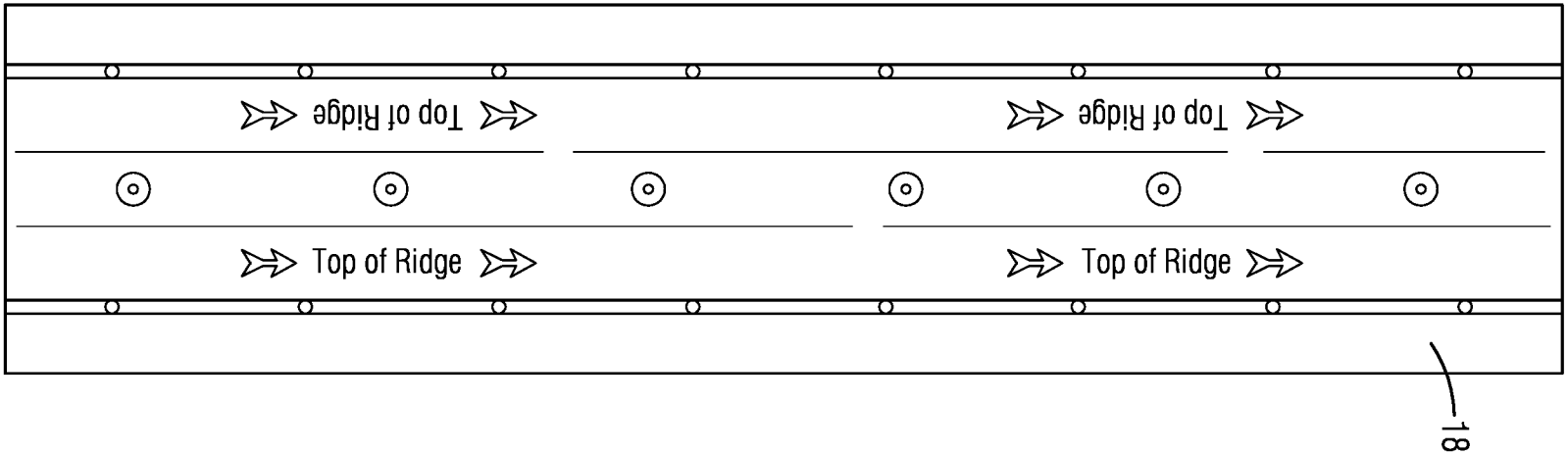
Figure 3C:
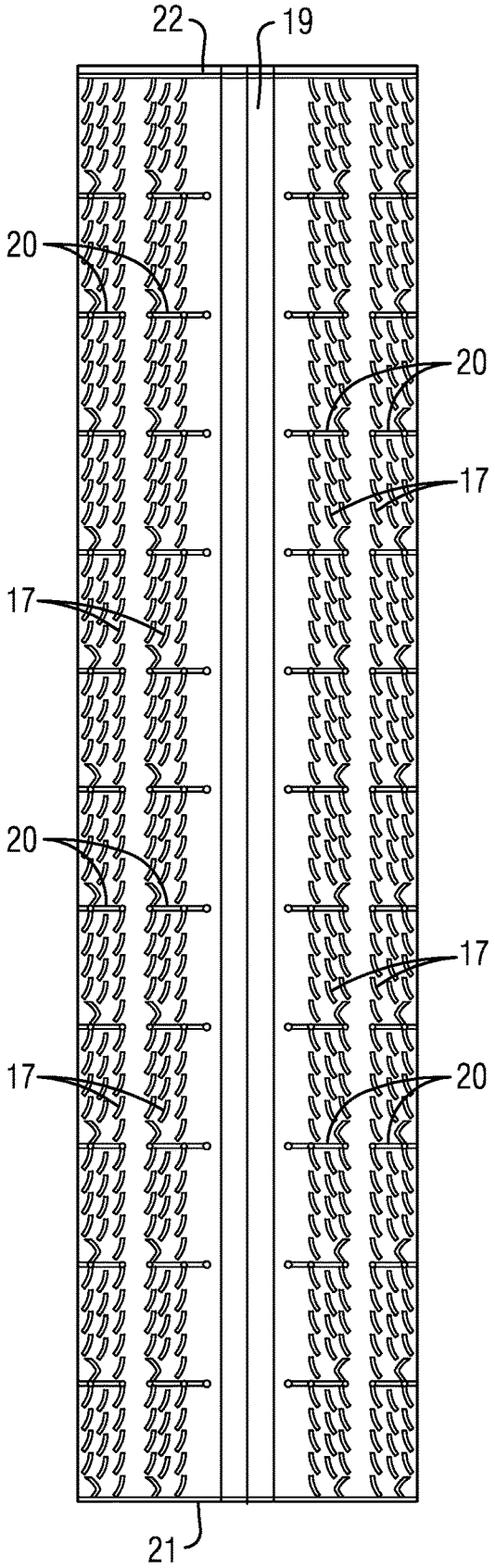

FIGS. 3*a*-3*c* show, from left to right, an edge view of the hip vent of the invention, a top plan view of the hip vent, and a bottom plan view of the hip vent. The laterally flexible top panel 16 and depending baffle arrays 17 can be seen in the edge view as they would be presented to windblown rain or snow on a roof. The vent is substantially thinner than prior art hip vents to provide a more aesthetically pleasing low profile appearance on a roof. This is particularly important for ridge vents, which can be more visible from a distance than a traditional ridge vent. The top view of FIG. 3*b* illustrates the upper surface 18 of the laterally flexible top panel 16, which may be embossed with various lines, nailing locations, and indicia to aid an installer during installation of the hip vent.

Figure 4:
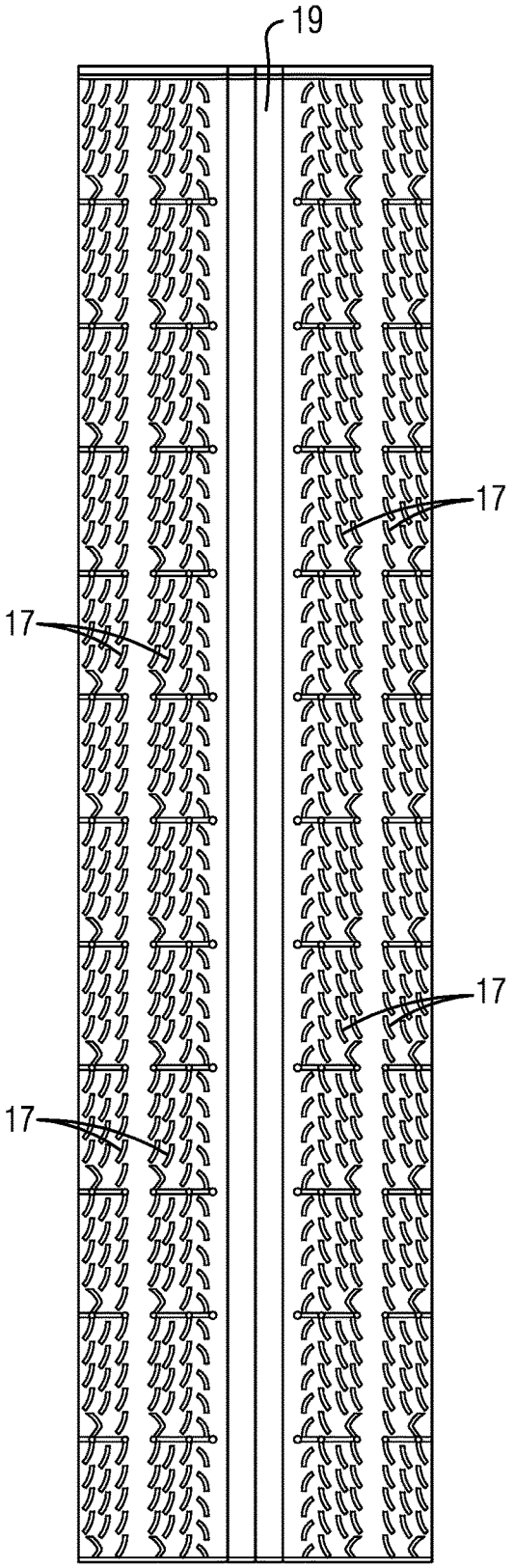
FIG. 4 is a more detailed bottom plan view of the hip vent of FIGS. 2 and 3 showing various elements of the weather resistant baffle array structure.

The bottom view of FIG. 3*c* illustrates the lower surface 19 of the laterally flexible top panel 16 and again shows the baffle arrays 17 and barrier walls 20 extending along the left and right edge portions of the panel. The barrier walls 20 separate the baffle arrays from each other, form wind brakes, and are configured to rest on a shingled roof below to support the hip a predetermined distance above the roof. Weather barriers 21 and 22 may be provided at the ends of the hip vent extending downwardly from the top panel 16 to prevent infiltration of rain water from the ends. Mating connector structures also may be provided on the ends so that a plurality of hip vents can be installed in end-to-end relationship and will be water resistant at their junctions. FIG. 4 also shows the bottom of the hip vent with the lower surface 19 and baffle arrays 17 visible.

Figure 5:
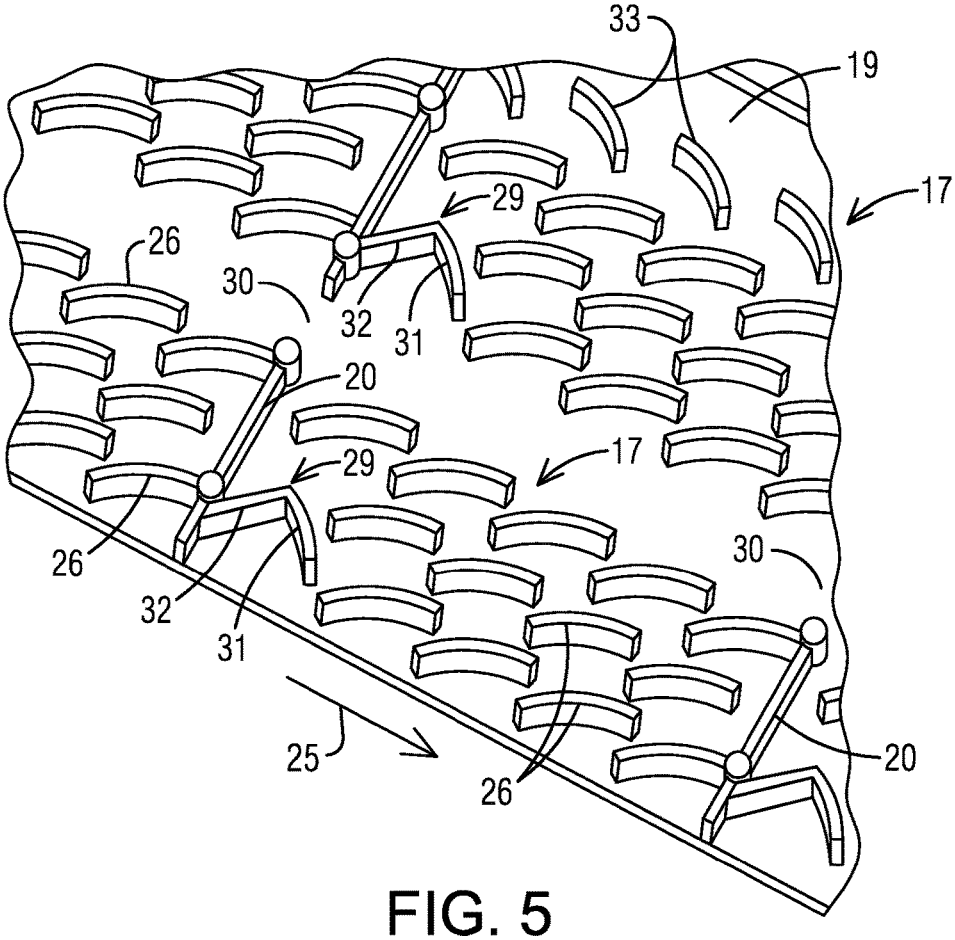
FIG. 5 is an enlarged view of a portion of the bottom of the hip vent of FIG. 4 illustrating more details of the baffle array structure.

FIG. 5 illustrates one preferred embodiment of the baffle arrays of the hip vent, which are designed with an aerodynamic shape to deflect rainwater away from the vent and onto the sloped roof when installed. The vanes also are configured to help prevent wind-blown rain from blowing through the baffle arrays and leaking into an attic space through the ridge slot. In FIG. 5, the down slope direction when the hip vent is installed is indicated by arrow 25. Each of the baffle arrays 17 comprises a plurality of curved vanes 26 that arc downwardly and outwardly when the hip vent is installed on a roof. The arcuate vanes of each array are spaced relative to each other so that no straight uninterrupted path is formed from the outside edge of the hip vent through the array of vanes. Further, the lower ends of the vanes in each row of vanes overlap slightly the upper ends of the next downslope vane of the row. In this way, water that may seep or be blow past the lower end of one vane is likely to encounter the next downslope vane and be shed away from the hip vent by that vane. Vanes 33 are arranged along the inner edge of the inner array.

Each baffle array 17 is bounded at its upslope end by a barrier wall 20 and bounded at its downslope end by a barrier wall 20, each of which extends generally transversely relative to the hip vent. These barrier walls enhance the structural integrity to the hip vent, provide wind brakes between the baffle arrays, and help to support the vent and prevent it from collapsing when installed on a hip roof with nails or other fasteners. Each of the barrier walls 20 comprises an inner portion adjacent the center of the central panel and an outer portion adjacent the edges of the central panel. The inner and outer portions of the barrier walls are separated by gaps 30 for purposes described in more detail below.

The outermost and lowermost vane 29 of each baffle array in this embodiment has an arcuate portion 31 that is oriented substantially transverse to the orientations of the arcuate vanes 26 and a straight portion 32 that extends from the inner end of the arcuate portion 31 to connect integrally to the barrier wall 20. This insures that there is no free path for water to be blown beneath the hip vent along the upslope sides of the barrier walls. The downslope sides of the barrier walls have arcuate vanes 27 integrally connected to and extending therefrom so that no path for water is formed along the downslope sides of the barrier walls either.

Figure 6:
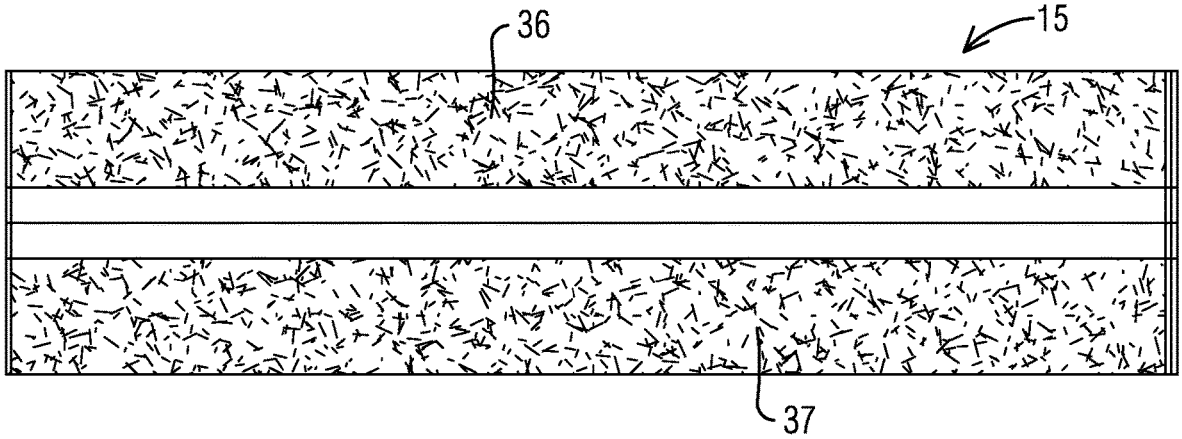
FIG. 6 is a bottom plan view of a hip vent according to the invention showing a pair of bottom filler strips attached thereto according to an embodiment thereof.

FIG. 6 illustrates another aspect of the hip vent 15 of the present invention; namely, a pair of filler strips 37 is attached to and extend along the bottoms of the baffle arrays. The filler strips are constructed of a spongy conformable material such as a mat of non-woven polymer strands, foam, or other material that is sufficiently conformable to a surface. When installing the hip vent 15 along the hip of a roof, gaps can result between the shingles of the roof and the bottoms baffle arrays. This is particularly true for roofs shingled with highly textured and layered architectural shingles, which are popular among homeowners. Rainwater and snow can be blown through these gaps and can leak through the hip slot into the attic below. The filler strips 37 address this issue by conforming to the uneven top surfaces of the shingles on either side of the hip when the hip vent is installed. Any would-be gaps are thus filled by the filler strips to block rainwater from seeping through. An additional advantage of the filler strips is that, unlike prior art hip vents, no caulking is required during installation to fill gaps between the hip vent and the shingles of the roof. This eliminates installation errors and erosion over time that can result in leaks.

Figure 7:
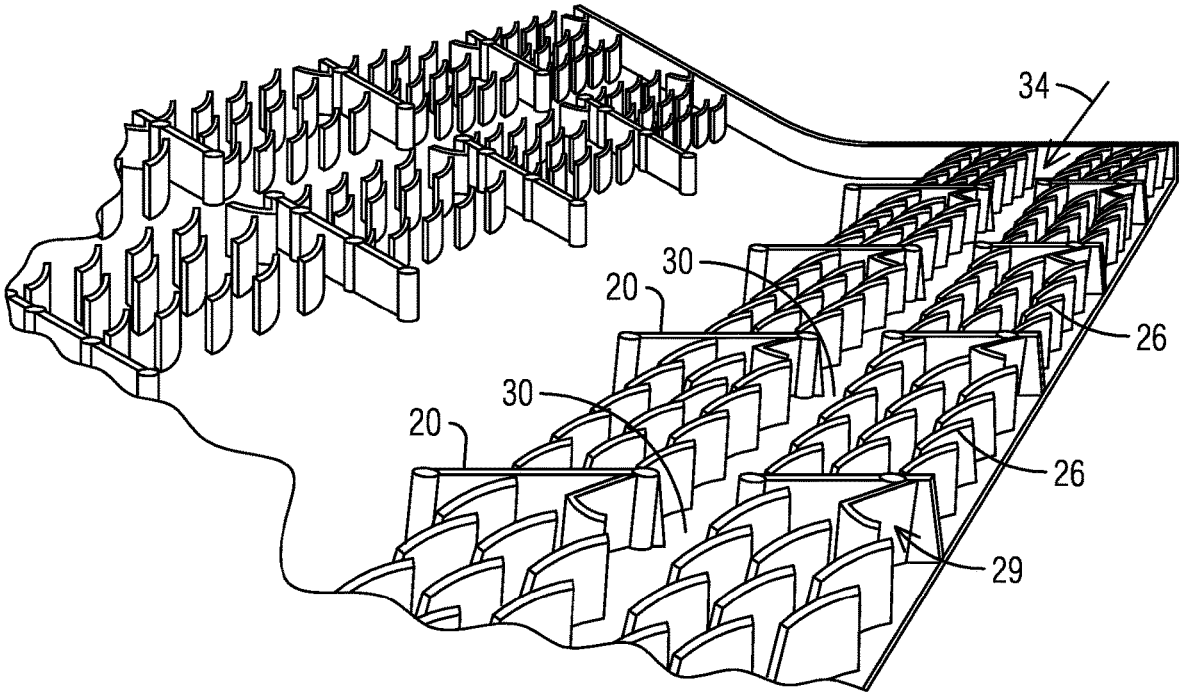
FIG. 7 shows a portion of the underside of the hip vent of this invention seen from another angle and further illustrating the baffle array.
Figure 8:
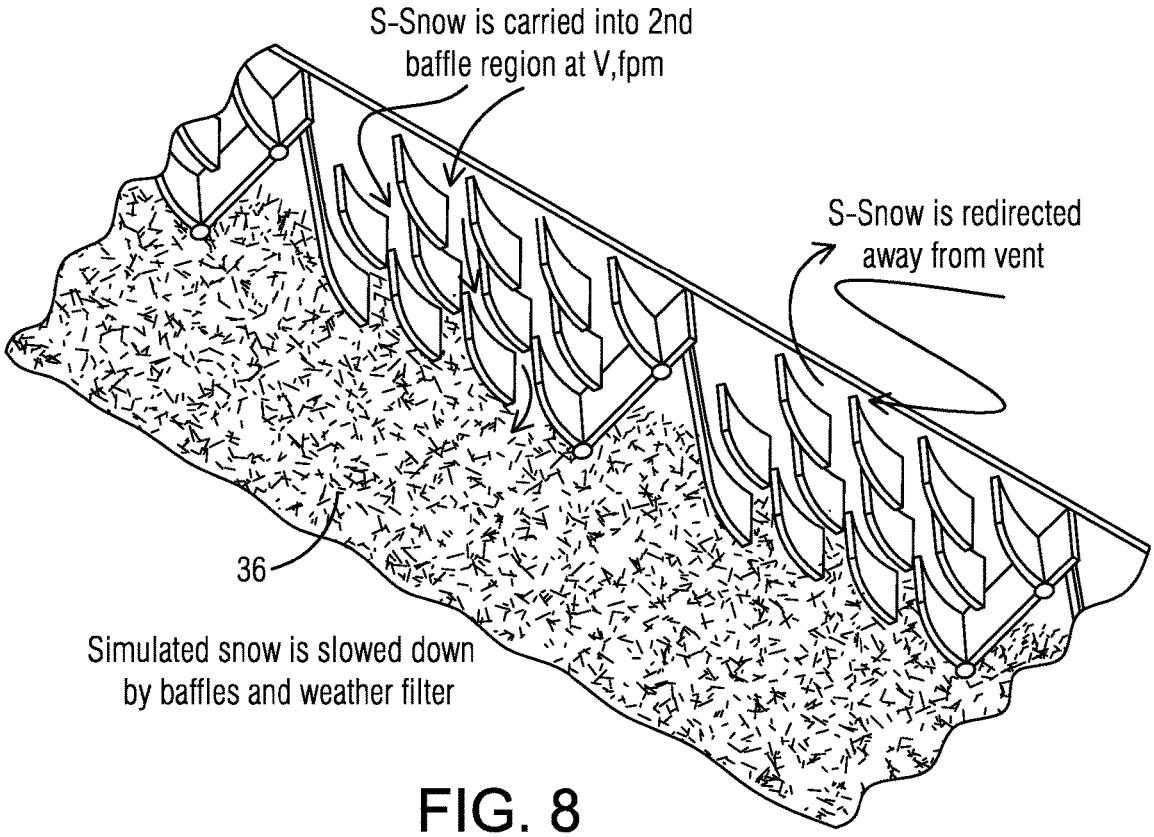
FIG. 8 is a perspective enlarged view of one edge of the hip vent showing a preferred method of attaching an air permeable weather filter to the bottom portion of the hip vent.

As perhaps best shown in FIG. 7, the baffle arrays 17 are arranged along each edge portion of the hip vent in two rows that are spaced apart from each other to define a longitudinal gap indicated by arrow 34. Further, each baffle array itself preferably comprises three rows of arcuate vanes spaced as described above so that no straight uninterrupted path for water is defined through the array. The gap 34 divides the baffle arrays into two regions, an outer region and an inner region and the gaps 30 in the barrier walls 20 align with the gap 34. As shown in FIG. 8, a mesh made of air permeable non-woven polymer vent material 36 is draped over the baffle arrays of the inner region and is welded, heat staked, or otherwise attached along the insides of these baffle arrays and on the outsides within the gap 34. This forms a weather filter encasing the inner regions of the baffle arrays through which attic air can pass out but through which wind-blown rain and snowflakes cannot pass in.

Figure 9:
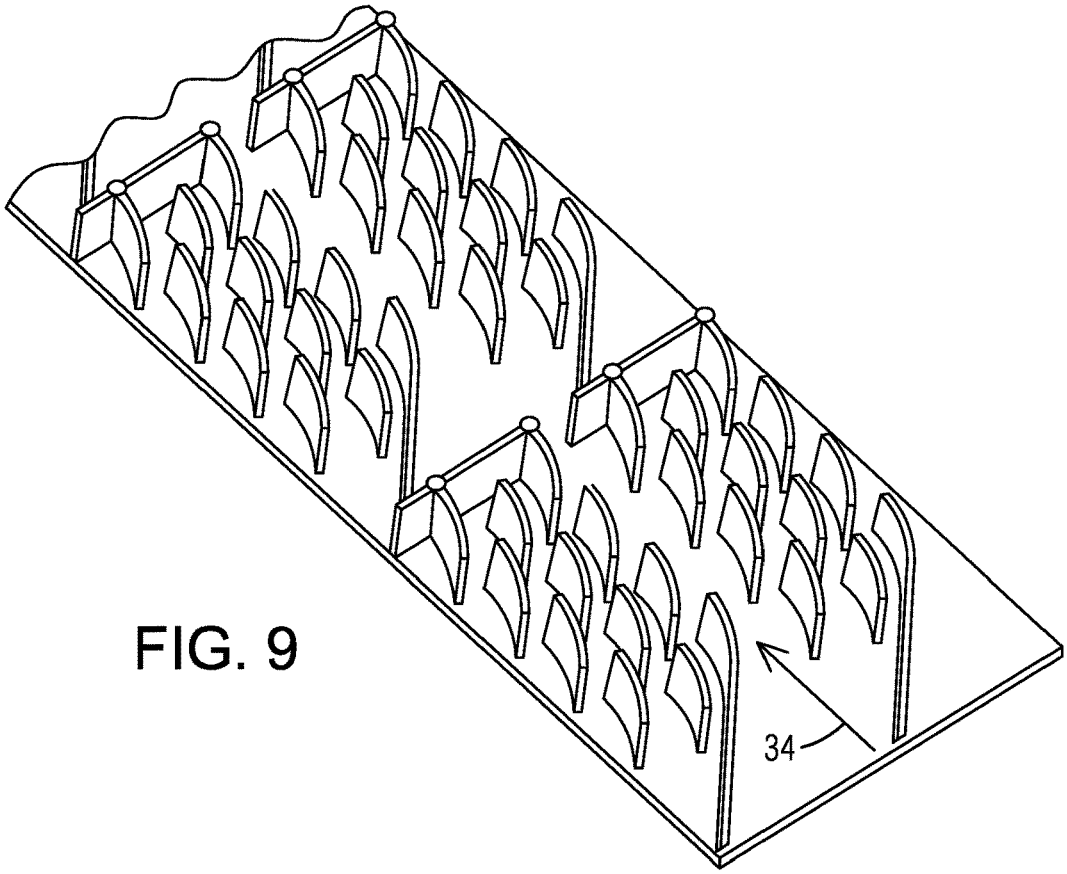
FIG. 9 is a perspective enlarged view of a portion of the bottom of the hip vent illustrating the weather filter weld area where the weather filter is attached.

The weather filter 36 is particularly effective for stopping wind-blown snow. Snowflakes behave differently than rainwater in that they can be blown around the arcuate vanes of the baffle arrays and make their way toward the hip slot. With the weather filter 36 in place, any snowflakes that make it through the baffle arrays of the outer region are entangled and trapped within the material of the weather filter and do not penetrate through the baffle arrays of the inner region. Eventually these snowflakes melt and drain away from the hip of the roof. In addition, some snowflakes are redirected away from the vent by the aerodynamic shape of the arcuate vanes in the outer region. This combination has proven to provide a robust and reliable barrier against infiltration of wind-blown snow into an attic space below. FIG. 9 also shows the gap 34 between the baffle arrays of the inner and outer regions where one edge of the weather filter is welded, heat staked, or otherwise attached.

Figure 10:
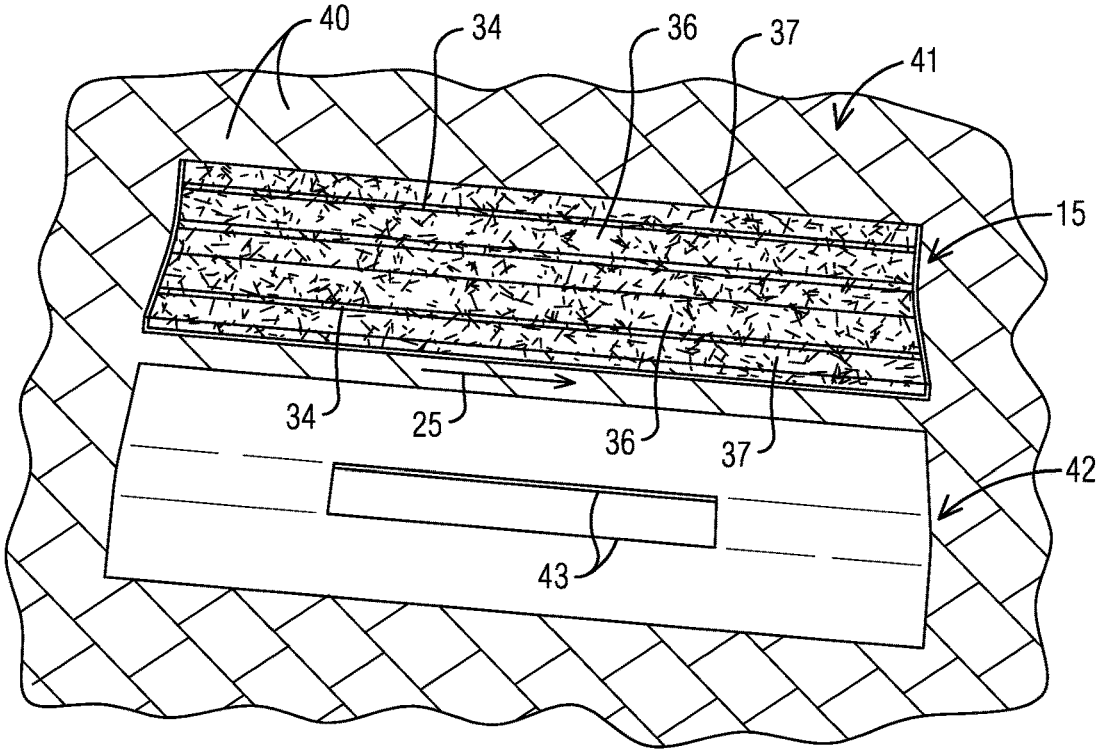
FIG. 10 shows a hip slot formed along a roof hip and a hip vent according to the invention lying next to the slot upside down with its weather filter attached.

FIG. 10 shows a hip roof 41 covered with shingles 40 and having a hip 42 sloping in the down-slope direction 25. A hip slot 43 is cut in the roof and extends along the hip to provide a ventilation path for the attic space below. Lying on the roof 41 next to the hip 42 is a hip vent constructed according to the present invention. The vent is shown upside down in FIG. 10. The weather filter 36 is shown draped over and welded in place covering the baffle arrays of the inner region. As mentioned, the weather filter 36 is welded or otherwise attached in the gaps 34 between the inner and outer regions of baffle arrays in such a way that the encase the inner baffle arrays. The weather filter also may be welded or otherwise attached to the underside of the flexible panel along the inner sides of the inner regions of baffle arrays. In this way, snow and/or rainwater must pass through two layers of the weather filter to reach the ridge slot 43 when the hip vent is installed. In fact, the weather filter may cover both the inner and outer baffle arrays if desired to provide an even more enhanced resistance to windblown rain and snow. Also seen in FIG. 10 are the two conformable filler strips 37 extending beneath each edge portion of the hip vent, where they are attached by welding, heat staking, or other appropriate attachment means.

The hip vent 15 shown in FIG. 10 is installed by being flipped over, positioned along the hip so that it straddles and overlies the hip slot 43, and attached to the roof deck on either side of the hip slot with fasteners such as nails. When so installed, the filler strips 37 compress against the shingles 40 and, due to the spongy nature of the filler strips, conform to the surfaces of the shingles. While standard three tab asphalt shingles are shown in FIG. 10, many roofs are shingled with much thicker and textured architectural shingles. In such installations, the filler strips can conform to radical differences in the heights of shingle surfaces thereby filling gaps that would be formed without the filler strips. It has been found that the filler strips eliminate the need for caulking to seal between the shingles and the edges of the hip vent.

Figure 11:
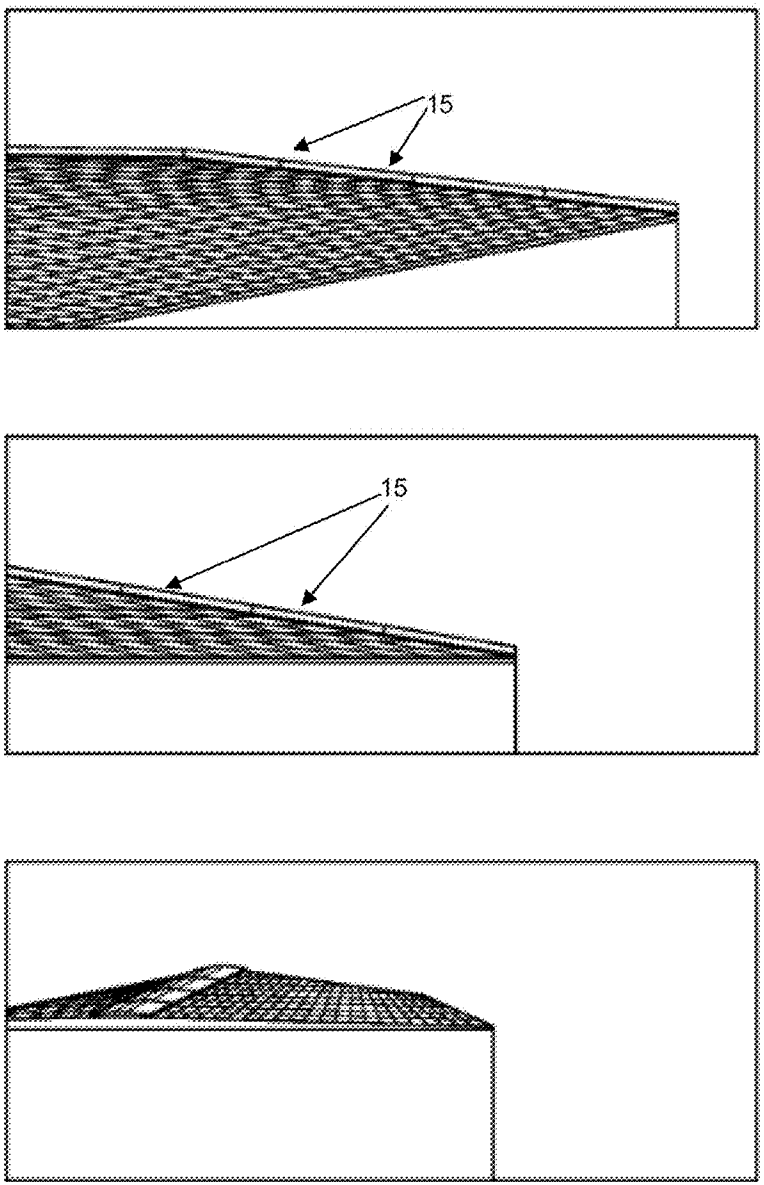
FIG. 11 illustrates the results of wind-blown rain testing of the hip vent of this invention and illustrates the vent's exceptional resistance to water penetration under severe storm conditions.

FIG. 11 shows the results of rain penetration testing of the hip vent disclosed herein. A hip vent according to the above disclosure was installed along the hip of a mock hip roof as described above. Simulated windblown rain was then directed from a rain machine toward the hip covered by the hip vent. The tests were conducted with rain blown at the hip from zero degrees (i.e. along the hip), forty-five degrees to the hip, and ninety degrees to the hip. At each of these angles, tests were conducted at wind speeds of 35, 70, 90, and 110 miles per hour as per Miami WDR TAS-100(a)-95 protocol. Any water that seeped into the space below the roof was collected and its volume measured. Miami WDR TAS-100(A)-95 protocol allows a maximum of 1500 ml of water for the vent to pass the test. As shown on the right in FIG. 11, only with 110 mph windblown rain did any water leak into the attic through the hip slot. Even then, the amounts were only 25 ml at zero degrees and 20 ml at 90 degrees. These amounts are considered in the industry to be negligible and fall well within the parameters for certification of attic ventilation products.

The invention has been described above within the context of preferred embodiments and methodologies considered by the inventors to represent the best modes of carrying out the invention. It will be understood by the skilled artisan, however, that a wide array of additions, deletions, and modifications, both subtle and gross, might be made to the example embodiments without departing from the scope of the invention itself. For instance, while the vent has been described as a hip vent for use along the hips of hip roofs, which is its intended use, there is no reason why it would not function perfectly well along the ridge of a gable or other type roof. The vanes of the baffle arrays in the preferred embodiment are circular arcs in shape. However, other shapes such as V-shaped, polygonal shaped, chevron shaped, spiral shaped, or other shapes might be used to obtain equivalent results. The disclosed hip vent may be used with or without the weather filter and with or without the filler strips depending upon application. For example, the weather filter may not be needed in areas of the country that do not experience snow storms or high velocity rain storms. The filler strips may not be needed when installing the hip vent on roofs with flat non-textured shingles (although filler strips are still considered by the inventors to be advisable). Further, the filler strips may be attached to the bottoms of hip vents either in the factory or in the field as needed. If installed in the field, they need only be attached with adhesive along the bottoms of the outer (and/or inner) wind baffle zones. As an alternative to the weather filter disclosed in the preferred embodiment, an air permeable insert may be formed and installed within and along the gap between the wind baffle zones. Such an insert may be made of recycled fibers, polymeric fibers, co-mingled fibers, natural fibers, mixtures of the forgoing, and layered or dual density material. Such inserts also may be formed with holes, passageways, or slots that allow air to flow but form barriers to windblown rain, snot, and insects. Finally, the hip vent of the preferred embodiment is made of injection molded plastic. It will be understood, however, that other materials such as metal may be substituted without departing from the spirit and scope of the invention. These and other modifications are possible, and all are intended to fall within the scope of the present invention.

We claim:

1. A vent comprising:

a top panel having a bottom surface, a top surface, a central portion and side portions terminating at lateral edges;

wherein the top panel is configured to be installed along a slot formed along a ridge or a hip of a roof to provide ventilation;

a plurality of baffle arrays positioned along the top panel between the central portion and the lateral edges thereof, the baffle arrays each comprising a plurality of spaced vanes projecting from the bottom surface of the top panel; and at least one filler strip extending along at least a portion of at least one of the baffle arrays, the filler strip comprising a material configured to conform to a surface of portions of the roof adjacent the slot when the hip vent is installed on the roof;

wherein the plurality of baffle arrays further comprises at least two laterally spaced baffle arrays arranged between the central portion and each of the lateral edges of the top panel;

wherein each baffle array comprises at least two rows each having at least two laterally spaced vanes;

wherein the vanes of the baffle arrays are spaced and arranged such that no uninterrupted path for water, snow, debris, or a combination thereof, is defined through the baffle arrays;

wherein the vanes of at least some of the baffle arrays each comprise a first end located nearer the central portion of the top panel, a second end located nearer an adjacent lateral edge of the top panel, and a curved configuration arcing downwardly and outwardly toward an adjacent lateral edge of the top panel;

wherein the second ends of the vanes are arranged along the bottom surface of the top panel so as to laterally overlap the first ends of adjacent vanes of an adjacent downslope row of vanes such that when the top panel is installed along the roof, water, snow, debris, or combination thereof, encountering the vanes is redirected away from the slot formed along the ridge or hip of the roof and toward the lateral edges of the top panel.

2. A vent as claimed in claim 1 further comprising a weather filter attached to the baffle arrays.

3. A vent as claimed in claim 2, wherein the weather filter comprises an air permeable polymer material.

4. A vent as claimed in claim 1 wherein the baffle arrays each comprise an inner region of vanes and an outer region of vanes separated by a longitudinally extending gap.

5. A vent as claimed in claim 4 further comprising an air permeable weather filter attached along the longitudinally extending gap between the inner and outer regions of each baffle array and positioned to encounter and arrest the water, snow, debris or combination thereof, attempting to travel through the baffle array.

6. A vent as claimed in claim 1, further comprising a plurality of spaced barrier walls positioned along the top panel, each of the barrier walls extending at least partially between a lateral edge and the central portion.

7. A vent as claimed in claim 6, wherein each of the barrier walls extend substantially transversely with respect to the central portion of the top panel.

8. A vent comprising:

an elongated top panel having a central portion, lateral edge portions, a top surface, and a bottom surface;

wherein the top panel is configured to be installed along a ventilation slot formed along a hip of a hip style roof to provide ventilation of an attic space below;

a plurality of baffle arrays projecting from the bottom surface of the top panel;

at least some of the baffle arrays comprising a plurality of vanes each having an arcuate shape arcing downwardly and outwardly toward an adjacent lateral edge portion of the top panel when the vent is installed along the roof, the vanes configured to arrest and direct water, snow, debris, or a combination thereof, away from the ventilation slot and toward the adjacent lateral edge portion;

wherein the plurality of baffle arrays comprises at least two laterally spaced baffle arrays arranged between the central portion and each of the lateral edge portions of the top panel, and including at least two rows extending across the top panel and each having at least two laterally spaced vanes;

wherein the vanes include a first end located nearer the central portion of the top panel, and a second end located nearer the adjacent lateral edge portion of the top panel, with the second ends of the at least some of the vanes overlapping at least some of the first ends of adjacent vanes of an adjacent downslope row of vanes;

wherein the vanes are spaced and arranged such that no uninterrupted path for water, snow, debris or a combination thereof, is defined through the baffle arrays from the lateral edges to the central portion of the top panel.

9. A vent as claimed in claim 8, further comprising a weather filter draped over at least a portion of the baffles, the weather filter comprising an air permeable polymer material configured to be substantially impermeable to the water and snow.

10. A vent claimed in claim 8, further comprising a filler strip attached to at least a portion of the baffle arrays, the filler strip configured to conform to adjacent roofing shingles and fill gaps between the adjacent roofing shingles and the baffle arrays.

11. A vent as claimed in claim 10, wherein the filler strip comprises a plurality of entangled fibers.

12. A vent as claimed in claim 8, wherein each baffle array comprises an inner region and an outer region separated by a longitudinally extending gap.

13. A vent as claimed in claim 12, further comprising an air permeable weather filter along the longitudinally extending gap between the inner and outer regions of each baffle array and positioned to encounter and arrest passage of the water, snow, debris, or combination thereof, through the baffle arrays.

14. A vent as claimed in claim 13, wherein the weather filter is draped over at least one of the inner or outer regions of each of the baffle arrays and attached along opposing sides thereof to form a double wall barrier.

15. A vent as claimed in claim 8, further comprising a plurality of barrier walls projecting from the bottom surface of the top panel, the barrier walls being interspersed among the baffle arrays and extending at least partially between a lateral edge and the central portion.

16. A vent as claimed in claim 15, wherein each of the barrier walls extend substantially transversely with respect to the central portion of the top panel.

17. A vent as claimed in claim 15, wherein at least some of the vanes comprise independent structures not connected to the barrier walls or adjacent vanes.

18. A method of directing water, snow, debris, or a combination thereof, away from a hip of a roof, the method comprising:

(a) positioning a hip vent along the hip of the roof, the hip vent comprising:

a top panel having a central portion and lateral edges; and a plurality of baffle arrays, each comprising a plurality of arcuate vanes extending downwardly from the top panel toward the roof, at least a portion of the arcuate vanes arcing in a direction away from the hip of the roof and being arranged relative to each other so that there is no uninterrupted path defined between an outside edge of the hip vent and the hip of the roof;

wherein the plurality of baffle arrays comprises at least two laterally spaced baffle arrays positioned between the central portion and each of the lateral edges, and each including at least two rows extending across the top panel and each having at least two laterally spaced vanes; and (b) securing the hip vent to the hip of the roof such that, when the hip vent is exposed to water, snow, debris or combination thereof, the hip vent directs the water, snow, debris or combination thereof, with the arcuate vanes away from the hip vent and onto an adjacent downwardly sloped region of the roof.

19. The method of claim 18, wherein securing the hip vent to the hip of the roof comprises attaching the hip vent to a deck of the roof along opposite sides of the hip with fasteners.

20. The method of claim 18, wherein the hip vent further comprises at least one filler strip attached to at least a portion of at least one baffle array of the plurality of baffle arrays, the at least one filler strip configured to conform to surfaces of adjacent roofing shingles, and wherein securing the hip vent to the hip of the roof further comprises compressing the at least one filler strip against the surfaces of the adjacent roofing shingles to fill gaps between the adjacent roofing shingles and the at least one baffle array.

21. The method of claim 18, wherein each of the vanes of the baffle arrays includes a first end located near the central portion of the top panel, and a second end located nearer an adjacent lateral edge portion of the top panel, and wherein positioning the hip vent along the hip of the roof comprises orienting the hip vent in a downslope direction along the hip of the roof with the second ends of the at least some of the vanes overlapping the first ends of adjacent vanes of an adjacent downslope row of vanes.

22. The method of claim 18, further comprising attaching a weather filter to the top panel, with the weather filter substantially covering the at least one baffle array.

23. The method of claim 18, wherein positioning the hip vent along the hip of the roof comprises positioning a plurality of hip vents in an end-to-end relationship along the hip of the roof.

24. The method of claim 23, further comprising engaging mating connectors at ends of adjacent hip vents to form a water-resistant connection between the adjacent hip vents.

* * * * *